United States Patent [19]

Weber

[11] Patent Number: 5,070,221

[45] Date of Patent: Dec. 3, 1991

[54] SWITCH DEVICE

[75] Inventor: Edwin Weber, Gärtringen, Fed. Rep. of Germany

[73] Assignee: Kautt & Bux KG, Fed. Rep. of Germany

[21] Appl. No.: 504,404

[22] Filed: Apr. 3, 1990

[30] Foreign Application Priority Data

Apr. 4, 1989 [DE] Fed. Rep. of Germany ..... 3910812

[51] Int. Cl.[5] ..... H01H 1/00

[52] U.S. Cl. ..... 200/284

[58] Field of Search ..... 200/284

[56] References Cited

U.S. PATENT DOCUMENTS

| | | | |
|---|---|---|---|
| 2,856,492 | 10/1958 | Heyhal | 200/284 |
| 3,542,976 | 11/1970 | Moray | 200/284 X |
| 3,786,209 | 1/1974 | Bury | 200/284 X |
| 4,081,641 | 3/1978 | Piber | 200/284 X |

FOREIGN PATENT DOCUMENTS

| | | | |
|---|---|---|---|
| 150486 | 12/1984 | European Pat. Off. . | |
| 1097002 | 1/1961 | Fed. Rep. of Germany . | |
| 3041470 | 6/1982 | Fed. Rep. of Germany . | |
| 3118292 | 11/1982 | Fed. Rep. of Germany . | |
| 3209897 | 9/1983 | Fed. Rep. of Germany . | |
| 3315765 | 10/1984 | Fed. Rep. of Germany . | |
| 1139929 | 7/1957 | France | 200/284 |

*Primary Examiner*—Renee S. Luebke

*Attorney, Agent, or Firm*—Wigman & Cohen

[57] ABSTRACT

A switch, particularly an apparatus switch having at least one movable contact element is described. The switch can be moved by an activating member from a shut-off position into an operational position, and includes a housing that has at least one receptacle for an opposing contact element that can be contacted by the movable contact element in its operational position. The receptacle is initially unequipped with a contact but is formed to subsequently receive a contact from the outside.

14 Claims, 4 Drawing Sheets

SWITCH DEVICE

BACKGROUND OF THE INVENTION

1. Field of the Invention

The invention relates to an electrical switch device having at least one movable contact element, which can be moved by means of a switch activation member from a shut-off position to an operation position, and having a housing having at least one receptacle for an opposing contact element that can be contacted by the movable contact element when in its operation position.

2. Description of the Prior Art

In known switches having the above-mentioned characteristics, the movable contact element is formed as a bridge, the two end portions of which each contact one of the opposing contact elements when the switch is closed, which opposing contact elements are nondetachably secured in a suitable manner in the switch housing. These opposing contact elements are generally provided with a screw connection, plug connection or soldered connection. In mounting the apparatus in which the switch is installed, the switch housing must be connected to the apparatus, by means of screws or the like. In addition, the connection between the leads and the leads of the opposing contact elements must be established.

OBJECTS AND SUMMARY OF THE INVENTION

A primary object of the invention is to an electrical switch device, is more economical to connect with the associated apparatus than conventional switches.

Because switches of this type are generally not equipped or not completely equipped with the necessary opposing contact elements, at least the mounting costs for the missing opposing contact elements are eliminated. In switches having a movable contact element which on one side is in continuous contact with the associated electrical circuit and therefore only cooperates with a single stationary contact element, this single stationary contact element can be missing.

The switch according to the present invention is incapable of functioning until the missing stationary contact element or missing stationary contact elements have been placed into the associated receptacles. Preferably, this occurs during the mounting of the switch in the apparatus wherein each missing stationary contact element is introduced into its receptacle. To arrange the introduction of a stationary contact element of this type as simply as possible, in one preferred embodiment the receptacle has an insertion opening through the wall of the switch housing. This insertion opening is preferably formed as a guide channel for the contact element, so that it is assured that this contact element will come into the correct position in the switch as it is inserted.

For a correctly functioning arrangement of the subsequently introduced contact element it is also advantageous if the portion of the receptacle located inside the housing contains a support surface facing the movable contact element for the contact element to be introduced, which at least partially forms the opposing contact element.

In one preferred embodiment the switch housing is provided with one portion of a plug connection, whereby this plug connection is formed such that its plug direction coincides with the direction in which the opposing contact element must be introduced into the switch housing. In that way only a single plug process is required to correctly position the switch in the apparatus and to introduce the contact element or contact elements into the switch. Particularly advantageous is an arrangement of the portion of the plug connection provided on the wall of the housing coaxially to the insertion opening for the opposing contact element.

So as not to require more screws to secure the switch in its correct position, in one preferred embodiment, at least one detent connection is provided consisting of a resilient pawl and a notch, which detent connection engages at the end of the insertion process.

The shape of the opposing contact element can be freely selected within wide bounds. However, the shape of a rack or panel plug connector is very advantageous.

The switch according to the present invention can be completed by other means than by opposing contact elements securely arranged in the apparatus. When necessary, opposing contact elements can also be subsequently introduced that are provided with a plug connection, a screw connection or the like.

In one preferred embodiment, the opposing contact element is provided with at least one longitudinal slot extending to the end which comes to rest inside the housing. A wire can be clamped into such a longitudinal slot, thus simplifying the connection of the wire, which may, for example, belong to a lighting device. Such an arrangement may reduce the costs even further. Establishing wire contact in a longitudinal slot of this type is made especially easy by providing the wire in a channel crossing the longitudinal slot. The wire is secured in the longitudinal slot and supported by the wall of the channel.

To reduce costs even further, in one preferred embodiment, the two elements comprising the switch housing are joined by integral tabs which engage in corresponding openings as the housing elements are joined, and like the housing, have a shape that results in a detent connection.

BRIEF DESCRIPTION OF THE DRAWINGS

The invention is described in greater detail below with the aid of an exemplary embodiment illustrated in the drawings, where.

DETAILED DESCRIPTION OF THE PREFERRED EMBODIMENTS

Figure 1:
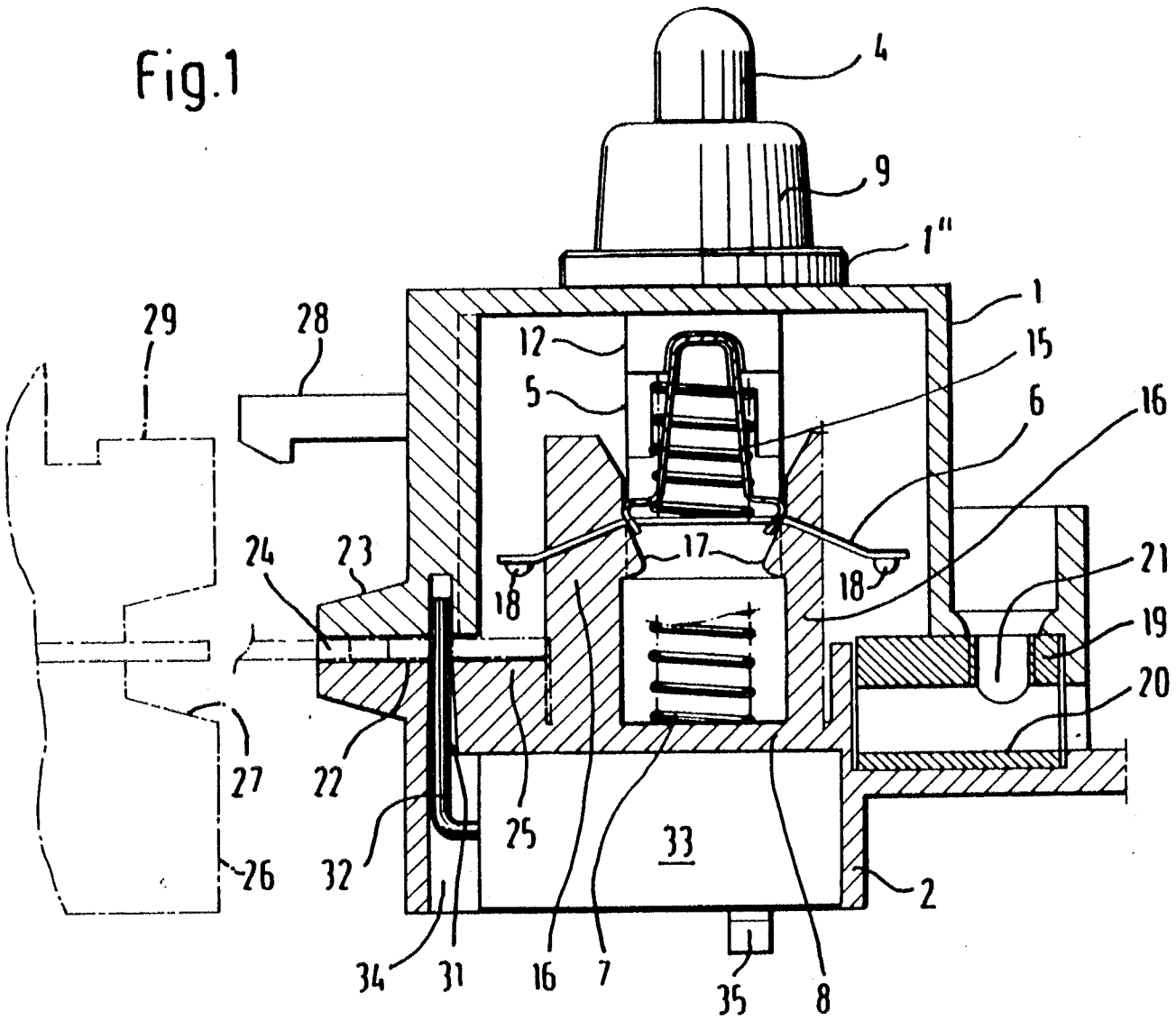
FIG. 1 is an elevational view of a preferred embodiment of the invention, in section taken along line I—I of FIG. 4.
Figure 2:
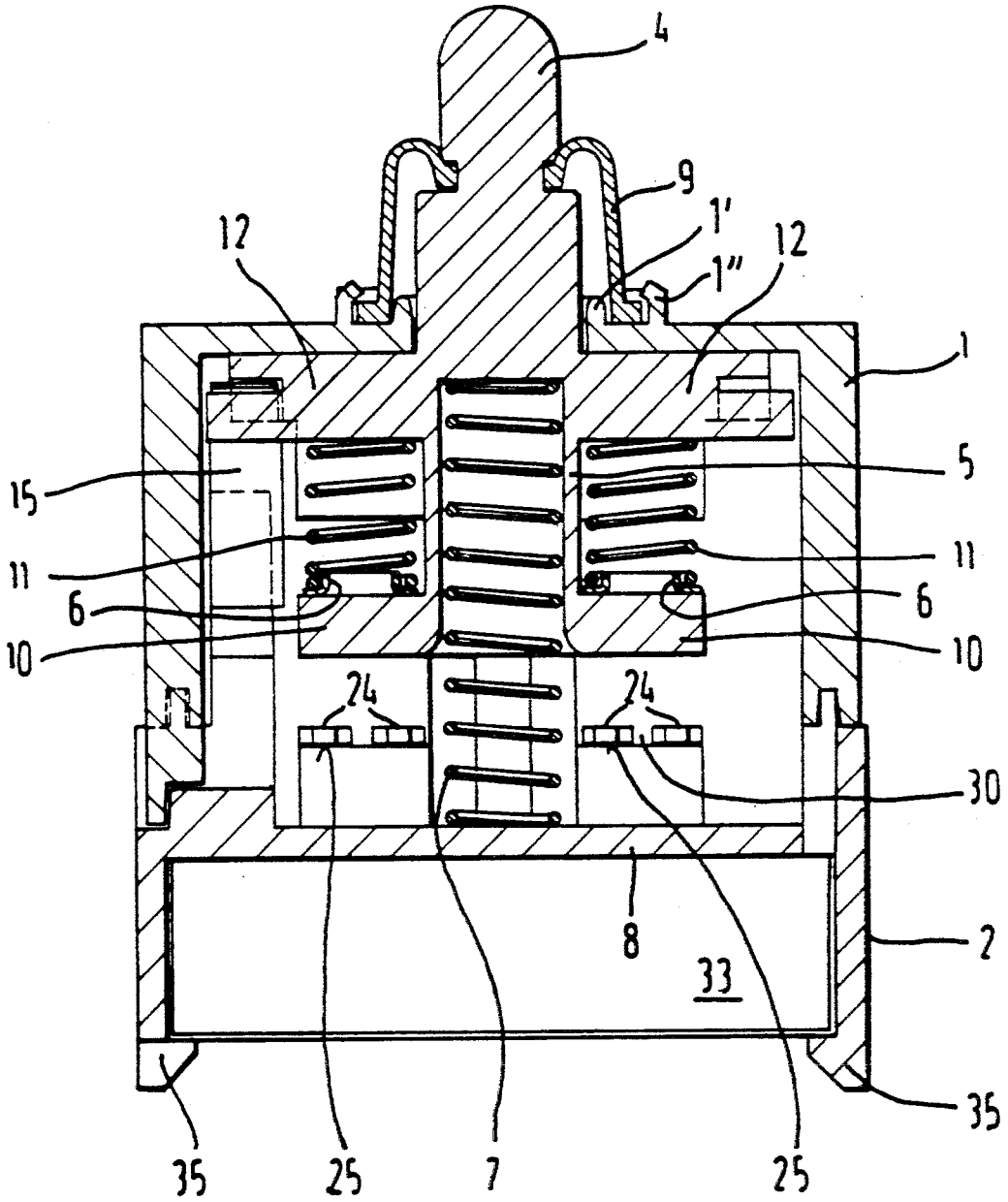
FIG. 2 is another sectional view taken along line II—II of FIG. 4.
Figure 3:
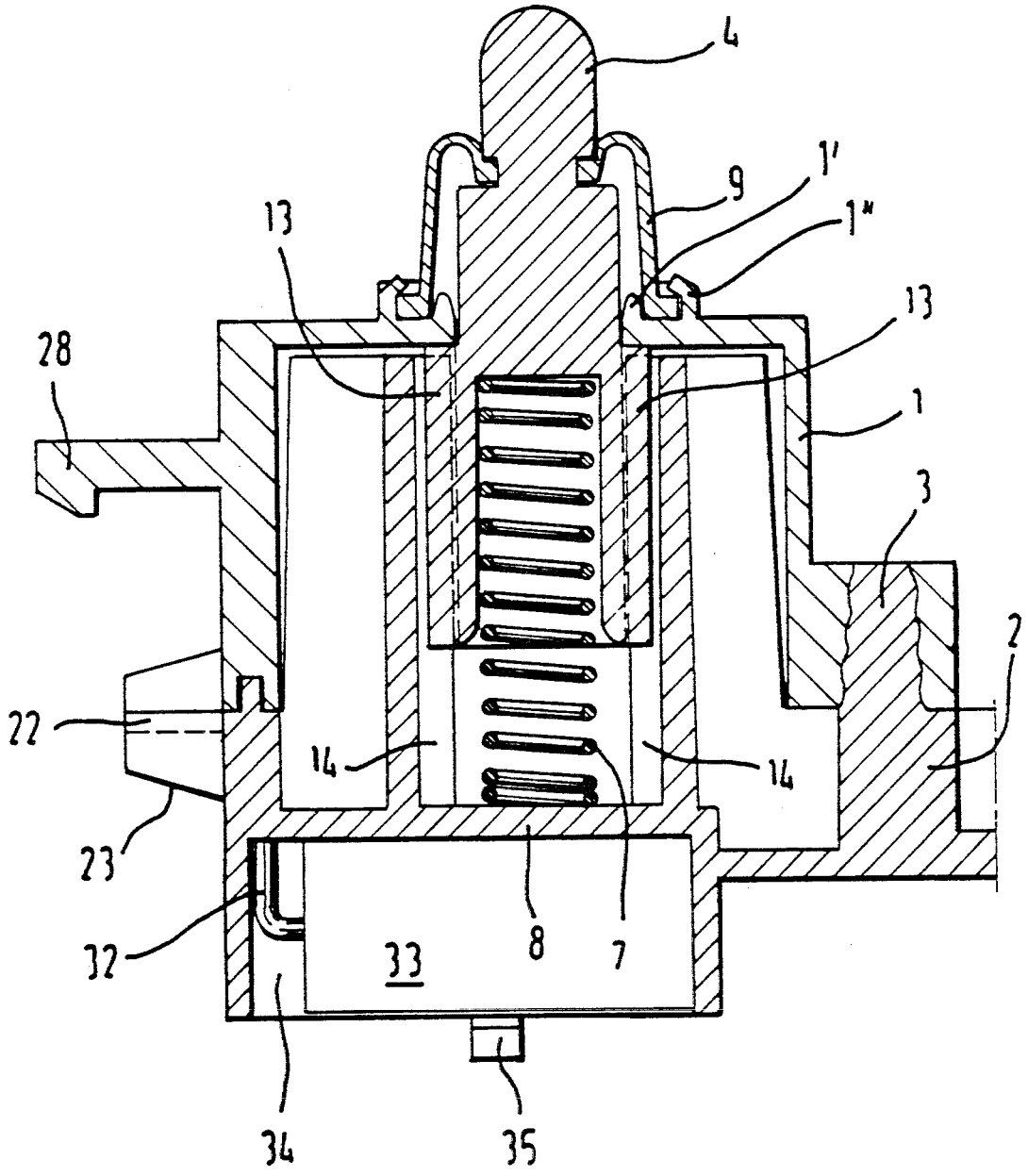
FIG. 3 is another sectional view taken along line III—III of FIG. 4.
Figure 4:
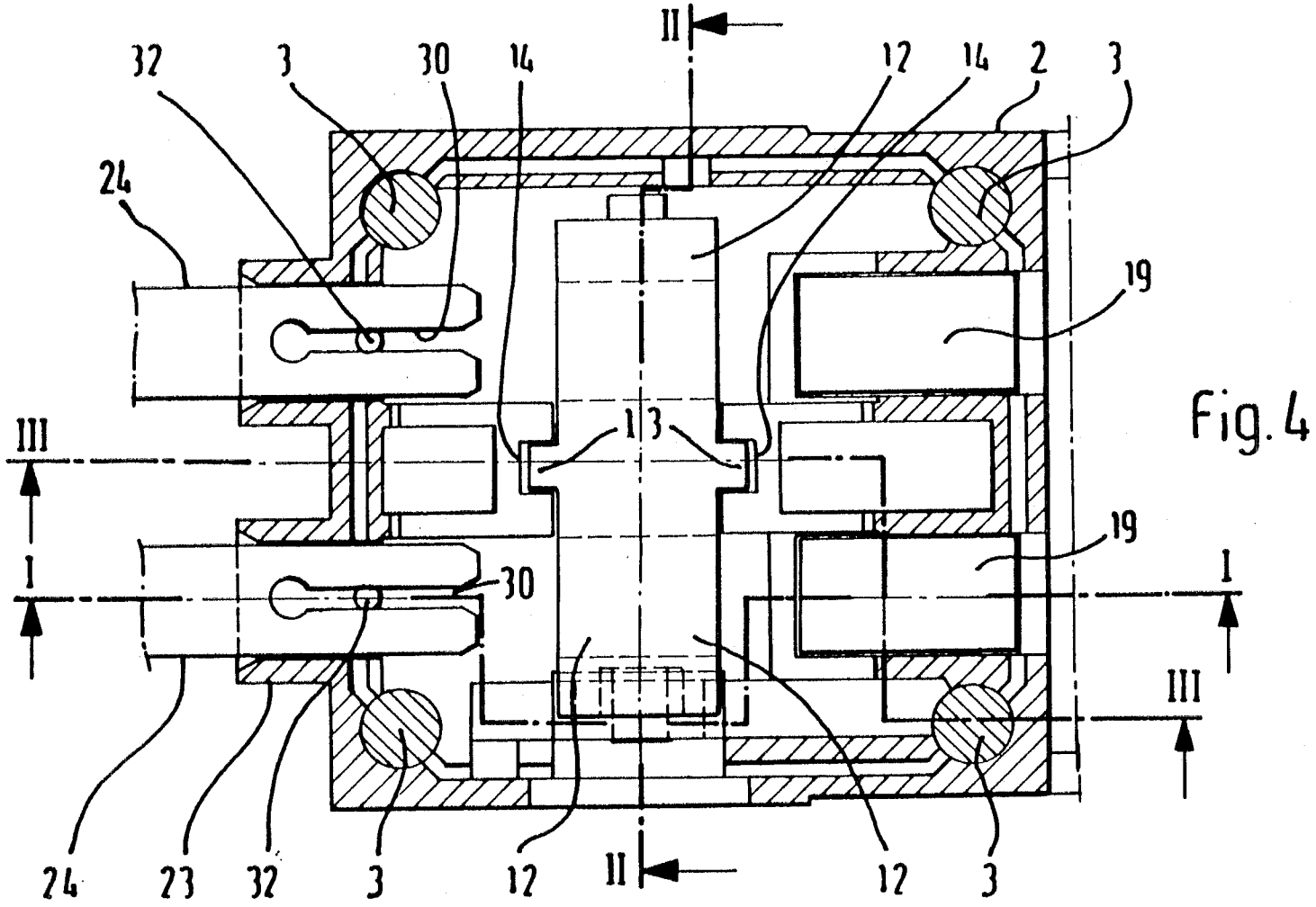
FIG. 4 is a plan view in section of a preferred embodiment in the plane of the stationary contact elements.

Referring now to the drawings wherein like elements are shown by like reference numerals throughout the several views, the switch device illustrated in FIGS. 1 through 4 has an essentially block-like switch housing which is comprised of an upper housing element 1 and a lower housing element 2. As shown in FIGS. 3 and 4, upwardly directed connecting tabs 3 are located in the four corner areas of the lower housing element 2 to connect the upper and lower housing elements, each of which are made of plastic. Connecting tabs 3 taper toward their upper ends and form a plurality of flat annular rings. These connecting tabs 3, which can also have a cross-sectional shape that deviates from a circle, engage in correspondingly shaped channels in the upper housing element 1, thus producing an automatic detent connection when the two housing elements 1 and 2 are brought together.

A passageway or opening for receiving a pin-like switch activating member 4 is provided in the upper side of the upper housing element 1. As seen in FIGS. 1 and 2, switch activating member 4 is formed on a bearing member 5. Two bridge contacts 6, of the double pole switch comprise two parallel, moving contact elements. A prebiased return spring 7, which is formed as a helical compression spring, engages in a recess in the bearing member 5 which is open toward the lower housing element 2 and is aligned with the switch activating member 4. The other end of return spring 7 is supported on the base 8 of the lower housing element 2.

Upper housing 1 terminates with an elastic rubber collar which is secured on one end in an annular groove in the switch activating member 4, and on the other end in a circular recess provided in the upper housing element 1. An internal support bead 1' and an external, inwardly rolled boundary wall 1'' seals the passage opening for the switch activating member 4. To close the switch, activating member 4 must be depressed against the force of the return spring 7.

At its lower end, the bearing member 5 has two diametrically opposite supports 10 for the two bridge contacts 6. Supports 10 project laterally to the direction of movement of bearing member 5. The two bridge contacts 6 are pressed against the lower supports 10 by respective helical compression springs 11. The other ends of the helical compression springs 11 are supported by two arms 12, which are integrally formed with the bearing member 5 at the upper end thereof. Arms 12 are located above the supports 10 and extend laterally in the same manner that supports 10 extend laterally from the bearing member 5, with respect to the direction of movement of bearing member. The central portion of bearing member 5 is provided with two guide ribs 13 (FIG. 3 and 4) which extend in the direction of movement of the bearing member 5 and are guided by a groove-like guide 14 in the housing portion, as shown in FIG. 4. At least one of the two arms 12 supports a shank spring 15 in the area of its free end, the shanks of which extend from the arm 12 toward the floor 8 and rest on respective sliding surfaces of a portion of material 16 of the lower housing element 2 which is spaced from the floor 8.

As shown in FIG. 1, two opposing sliding surfaces 17 are provided shaped as noses, which are engaged by the respective ends of the shank spring 15 when the bearing member 5 is in the closed position of the switch. By means of this forcible detent, a snap effect is achieved and reduces the force that must be exerted on the switch activating member 4 to hold it in the closed position after the switch is closed.

Respective stationary contact elements 19 (FIG. 4), which may include a screw connection, are associated with one end of the two bridge contacts 6, which are slotted in the longitudinal direction in their two end sections. Two contact elements 19 are located on the underside of each end section. These two stationary contact elements 19 are secured by the upper housing element 1 in the receptacle provided in the lower housing element 2. They each have a longitudinal bore 20 running laterally to the direction of movement of the bearing member 5 to receive the conductor to be connected thereto as well as a lateral bore 21 that is accessible from outside the housing, which contains a clamping screw (not shown). Of course, these two stationary contact elements 19 could also be provided with a plug connection or a solder connection.

On the side opposite the two stationary contact elements 19, the switch housing has two insertion openings 22 which are rectangular in cross-section, the longitudinal axes of which openings lie parallel to each other and to the axes of the longitudinal bores 20. The lower portion of the insertion openings 22 is limited by the lower housing element 2 and the upper portion thereof is limited by the upper housing element 1, enabling them to be produced without problem. As shown in FIGS. 1 and 4, truncated projections 23 are formed on the outside of the housing wall containing these insertion openings concentric to the two insertion openings 22, which form a portion of a plug connection and also lengthen the channel formed by the insertion openings 22.

The cross-section of the insertion openings 22 is adapted to the cross-section of type plug contact elements 24, which first pass through the insertion openings 22 into the interior of the housing as the switch is installed into the associated apparatus. As shown in FIG. 1, the lower housing element 2 includes an extension of the insertion opening 22, and a support surface 25 for the plug contact element 24 that extends to the material section 16. In addition, FIG. 1 shows that the insertion opening 22 and the support surface 25 are arranged such that the contact surface of plug contact element 24 facing the bridge contacts 6 lie in the same plane as the stationary contact surface of the contact element 19 secured in the switch housing.

The two plug contact elements 24 are formed by the end portions of respective bifurcated connectors which project beyond the surface 26 of the associated apparatus by the distance required for the support in the switch housing. Respective truncated recesses 27, concentric to the two bifurcated connectors, are provided in the surface 26, the shape of which corresponds to that of the projections 23. When the switch housing abuts the surface 26 a plug connection is therefore produced between it and the apparatus, which positions the switch and absorbs the forces that occur laterally to the insertion direction. A detent pawl 28 projects from the outside of the switch housing in the insertion direction and is formed integrally with the upper housing element 1; it engages behind a detent projection 29 on the apparatus when the switch abuts the surface 26, and thus secures the switch from becoming detached from the apparatus.

As shown in FIG. 4, the two bifurcated contact elements 24 are provided with a centrally located, longitudinal slot 30 that extends to the free end of the contact element 24. The two adjacent furcations thus formed are contacted by the respective contact elements 18 of the associated end section of the contact bridges 6 when the switch is closed. As shown in FIG. 1, the end sections of the bridge contacts 6 adjacent to a central section are curved toward the contact surfaces of the contact element 24. Thus, the contact elements 18 are pushed onto the contact elements 24 when the bridge contact 6 is pressed through into its extended position. This provides a self-cleaning effect for the contact surfaces.

Each longitudinal slot 30 of the two contact elements 24 is perpendicularly crossed by a channel 31 provided in the lower housing element 2 which extends into the upper housing element 1 for receiving the connecting wire 32 of an electrical component 33, e.g., a capacitor, to be electrically connected to the contact element 24. The diameter of the connecting wire 32 is somewhat larger than the width of the longitudinal slot 30. This achieves a good contact when the contact element 24 is introduced through the insertion opening 22 and the connecting wire 32 thereby enters into the conical longitudinal slot 30 and widens it somewhat.

To accommodate the component 33, the lower housing element 2 is provided with a downwardly open chamber formed by sidewalls each having retaining ledges 35 formed on the side walls. As shown in FIG. 2, ledges 35 hold the electrical component 33 in the chamber 34. Accordingly, the mounting of the electrical component 33 is extremely simple and economical.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A device for a switch comprising a switch actuating member, at least one movable contact element which can be moved from a shut-off position into an actuated position by means of said switch actuating member, and a housing wall formed with a receptacle for receiving an opposing contact element which can be contacted by the movable contact element in its actuated position, wherein said receptacle does not include a contact element but is adapted to receive a contact element from the outside that is introduced through the housing wall; wherein said receptacle has an insertion opening which penetrates the wall of the housing; and wherein a portion of the receptacle is located inside the housing and said portion of the receptacle has a support surface for the contact element to be introduced therein, which support surface faces the movable contact element.

2. A device for a switch according to claim 1, wherein said housing is formed of at least two elements, one element including means for securing said housing elements, said securing means being directed from one of said elements to the other and having a free end towards which they taper.

3. A device for a switch according to claim 1, wherein said insertion opening is formed as a channel for guiding the contact element therein.

4. A device for a switch according to claim 1, wherein said movable contact element is formed as a bridge and wherein only the receptacle associated with one end of the bridge is unequipped.

5. A device for a switch according to claim 4, wherein both end sections of said bridge are formed by two adjacent tongues.

6. A device for a switch according to claim 1, wherein said movable contact element is formed as a bridge and having two receptacles associated with the respective bridge ends, at least one of which is unequipped.

7. A device for a switch according to claim 6, wherein both end sections of said bridge are formed by two adjacent tongues.

8. A device for a switch according to claim 1, wherein said insertion opening is provided with one portion of an insertion means including a projecting portion to be received in a recess formed in an adjacent member.

9. A device for a switch according to claim 8, wherein said housing wall further includes a detent connection comprising a resilient pawl for engaging a detent notch.

10. A device for a switch according to claim 8, wherein the projecting portion of said insertion means is arranged to be coaxial with the insertion opening.

11. A device for a switch according to claim 10, wherein said housing wall further includes a detent connection comprising a resilient pawl for engaging a detent notch.

12. A device for a switch comprising a switch actuating member, at least one movable contact element which can be moved from a shut-off position into an actuated position by means of said switch actuating member, and a housing wall formed with a receptacle for receiving an opposing contact element which can be contacted by the movable contact element in its actuated position, wherein said receptacle does not include a contact element but is adapted to receive a contact element from the outside that is introduced through the housing wall, wherein said movable contact element is formed as a bridge and having two receptacles associated with the respective bridge ends, at least one of which is unequipped; wherein said bridge is formed to be elastic in its direction of movement and in its shut-off position the two end sections are displaced relative to the center section toward the receptacle.

13. A device for a switch comprising a housing, a switch actuating member, at least one movable contact element which can be moved from a shut-off position into an actuated position by means of said switch actuating member, a housing wall formed with a receptacle for receiving an opposing contact element which can be contacted by the movable contact element in its actuated position, wherein said receptacle does not include a contact element but is adapted to receive a contact element from the outside that is introduced through the housing wall, wherein a portion of the receptacle is located inside the housing, and said portion has a support surface for the contact element to be introduced therein, which support surface faces the movable contact element.

14. A device for a switch according to claim 13, wherein said receptacle includes an insertion opening formed as a channel for guiding the contact element therein.

* * * * *